US005167438A

United States Patent [19]

Fiesel et al.

[11] Patent Number: 5,167,438

[45] Date of Patent: Dec. 1, 1992

[54] GUIDES FOR MINERAL WINNING PLOUGHS

[75] Inventors: Heinz-Otto Fiesel; Gerhard Siepenkort; Bernd Steinkuhl, all of Lunen, Fed. Rep. of Germany

[73] Assignee: Gewerkschaft Eisenhutte Westfalia GmbH, Fed. Rep. of Germany

[21] Appl. No.: 744,389

[22] Filed: Aug. 13, 1991

[30] Foreign Application Priority Data

Aug. 16, 1990 [DE] Fed. Rep. of Germany ..... 4025871

[51] Int. Cl.[5] ..... E21C 35/12; E21C 29/14

[52] U.S. Cl. ..... 299/34; 299/43

[58] Field of Search ..... 299/34, 42, 43

[56] References Cited

U.S. PATENT DOCUMENTS 4,067,619 1/1978 Peters et al. ..... 299/43

FOREIGN PATENT DOCUMENTS 3330955 3/1985 Fed. Rep. of Germany .

8714741 2/1988 Fed. Rep. of Germany .

3737525 5/1989 Fed. Rep. of Germany ..... 299/34

3042203 6/1990 Fed. Rep. of Germany .

*Primary Examiner*—David J. Bagnell

*Attorney, Agent, or Firm*—Samuels, Gauthier & Stevens

[57] ABSTRACT

A plough guide which is built onto the runs of channelling of a scraper chain conveyor, has angle plates which form a slide path for the plough and which are connected by their upwardly extending sides to the runs of channelling. Sliding spacers are provided behind a covering between an upper chain channel and a lower chain channel. Covering hoods which form the covering for the channels are each pivotably mounted to a lower guide beam. The hoods can be swung over on the pivot joints towards the face in order to open the upper chain channel. The spacers are connected to the angle plates via fitting plates which are rigidly connected thereto and which extend upwards beyond the spacers. The fitting plates are provided with centering pins which engage centering apertures in the angle plates. The fitting plates can be connected to the sliding spacers and/or the angle plates by welding.

11 Claims, 2 Drawing Sheets

FIG.1
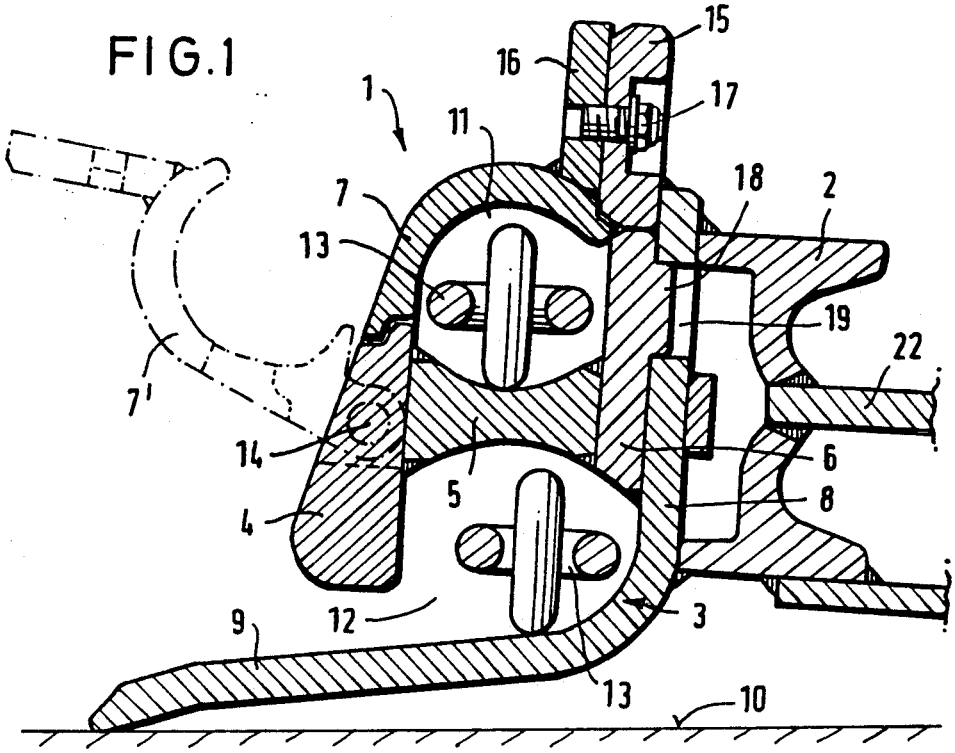
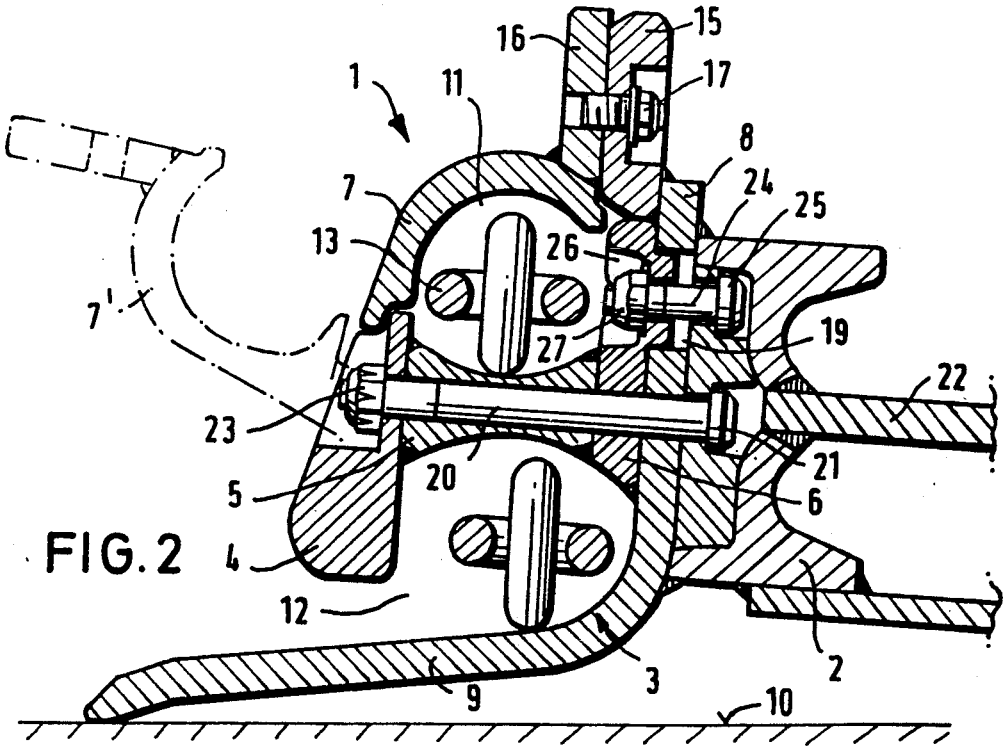
FIG.2

GUIDES FOR MINERAL WINNING PLOUGHS

FIELD OF THE INVENTION

The invention relates to a guide for a mineral, e.g. coal, winning machine such as plough.

BACKGROUND OF THE INVENTION

Plough guides are known in a number of versions, e.g. that described in DE-GM 87 14 741.6. In the known plough guide the guide is made up of sections which are regularly connected by horizontal screw-threaded bolts with the side walls of the channel sections or pans of a conveyor which are nearer to the face or with fittings rigidly mounted thereon. Each guide section is made up of an L-shaped angle plate, spacers fitted to an upstanding side wall of the angle plate to separate upper and lower chain guide passages or channels and a cover which shuts off the channels from the working face side. The screw-threaded bolts pass through the spacers and the angle plate and at the same time serve for securing the spacers. A second row of screws can be provided on a level with the upper chain channel in order to intercept the considerable forces transmitted from the plough to the guide. A guide beam forming part of a lower plough guide consists of a shaped sheet metal part or of a flat bar with a shaped piece of sheet metal welded onto it. With such plough guides it is also known to have adjacent sections of the guide, each with a length being approximately equal to that of one of the runs of channelling, connected at their ends by coupling elements, particularly chain links or toggle bolts. These elements can also replace the face side connections on the scraper chain conveyor (DE-OS-33 30 95 5, DE-PS-30 42 203).

An object of the invention is to construct the plough guide in such a way that it will be characterized by an assembly of increased strength and also by improved stability against the considerable forces occurring in the operation of the plough.

SUMMARY OF THE INVENTION

The invention enables this object to be achieved as a result of the fact that the spacers are connected with the upwardly extending sides or walls of the angle plates by fittings which are rigidly connected to the said spacers and which form the lateral internal boundary of the upper chain channel. The fittings which cover the vertical sides of the angle plates are preferably provided with centering pins engaging centering apertures in the vertical sides, preferably with a robust pair of centering pins in each case.

The fittings may be strong fitment plates which provide the connection between the sliding spacers and the vertical sides of the angle plates. By means of these fitting plates the high forces on the guide beam forming the lower guide can be reliably dispersed via the spacers to the angle plates or the runs of channelling of the scraper chain conveyor. The fitting plates also ensure a firm and positionally correct connection between the sliding spacers and the guide beam situated thereon, on the one hand, and the angle plates, on the other, and the fitting plates can at the same time strengthen the angle plates locally. From this point of view it is of particular advantage for the fitting plates to be provided with centering pins which engage centering apertures in the angle plates, particularly since the resulting tenon-dowel type of joint enables a strong positive connection to be obtained between the fittings and the angle plates.

Particular advantages are obtained if the fitting plates are welded to the vertical sides of the angle plates, especially if they are also welded to the spacers. These measures provide a firm structure and also simplify the assembly process, as the spacers which bear the guide beam and via which the forces of the plough are therefore dispersed do not have to be screwed on as separate parts but can be welded to the fitting plates and preferably to the guide beam with the angle plate likewise. This also enables the associated guide beam, the spacers, the fitting plates and the angle plate to be combined to form one single welded structure. This means that the plough guide, with the exception of the covering hood to be added, can be preassembled at the factory as a self-contained constructional unit, thus at least greatly reducing such operations on site. It is also possible for the sections of the plough guide to be welded, by the vertical sides of their angle plates, to those side walls of the runs of channelling of the scraper chain conveyor which are nearer to the face. In this case, therefore, the run of channelling, in conjunction with the welded-on plough guide section, forms a pre-assembled constructional unit which dispenses with securing screws subjected to heavy loads and which is characterized by considerable firmness.

If, on the other hand, the plough guide according to the invention is to be affixed by its sections to the runs of channelling by means of screw-threaded elements, it is advisable for the fitting plates to be provided, on the centering pins, with recesses or the like, as well as with holes through which elements can pass and by the aid of which the plough guide section is secured to the side wall of the run of channelling which is nearer to the face. Nuts placed on the elements then occupy a concealed position inside the recesses. A second row of elements is advantageously provided in the plane of the spacers, so that altogether a secure connection between the plough guide and the run of channelling can be obtained. This second row of elements can also be provided if the spacers are connected to the guide beam and to the fitting plates by welding.

It is above all when the spacers are welded to the fitting plates and the guide beam that these parts subject to high stresses should be made particularly strong. It is therefore advisable for the said plates to be constructed as robust drop forgings. For the guide beam it is of advantage to use a strong, rounded rolled section consisting of solid material throughout and increasing in thickness downwards. The spacers likewise may consist of forgings.

In accordance with a further advantageous characteristic of the invention, a guide bar extends upwards beyond the top of the vertical side of each angle plate and is welded to the latter with the covering hood resting against it by a contact bar. The covering hood, when in the closed position, can be detachably connected, e.g. by a screw connection, to the guide bar. The robust guide bars on the angle plates then form an upper guide for the plough and disperses the guide forces via the angle plates towards the runs of channelling. The hinged covering hood is therefore relieved of the high plough forces. The hood is also advantageously mounted at its ends in hinge joints situated on a level with the spacers, and preferably so mounted on the ends of the strong guide beam.

The fitting plates are preferably made to a length at least about equal to that of the spacers situated in the end zones of the plough guide section and its guide beam. The strong fitting plates also make it possible to provide, here in the immediate vicinity of the run of channelling, connectors, preferably toggle connectors, which interconnect the adjacent plough guide sections and which can replace, on the face side, the connections between the runs of channelling. The system is preferably so arranged so that the fitting plates are provided, on a level with the sliding spacers, with receiving compartments for the toggle connectors or coupling devices, interconnecting the adjacent plough guide sections.

The invention may be understood more readily, and various other aspects and features of the invention may become apparent, from consideration of the following description.

BRIEF DESCRIPTION OF DRAWINGS

Embodiments of the invention will now be described, by way of examples only, with reference to the accompanying drawings, wherein:

FIG. 1 is a vertical section through a plough guide constructed in accordance to the invention;

FIG. 2 is a vertical section through another plough guide constructed in accordance with the invention;

DESCRIPTION OF PREFERRED EMBODIMENTS

Figure 3:
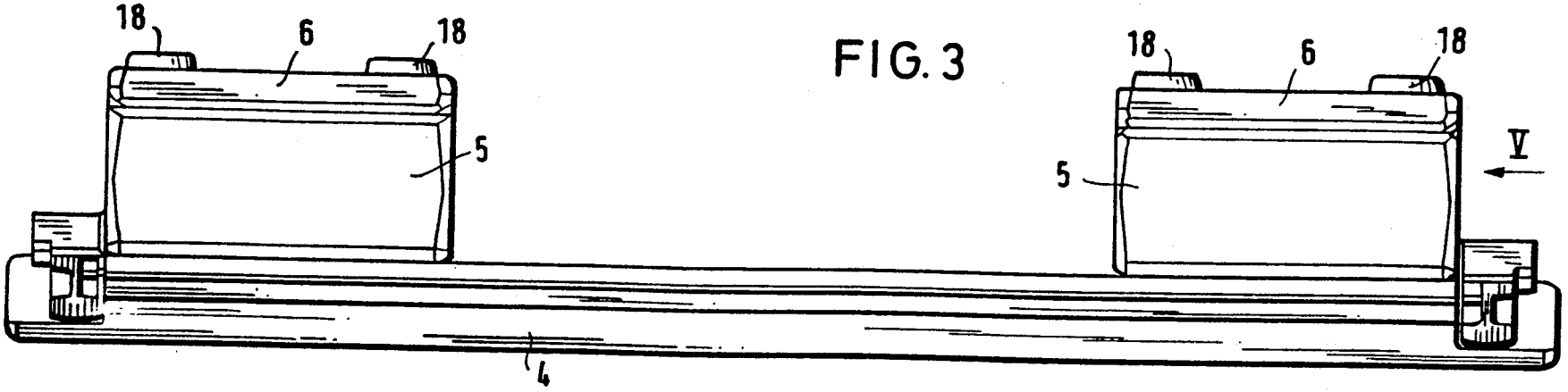
FIG. 3 is a plan view of an assembly usable in the plough guide according to the invention.

In the drawings, a guide 1 constructed in accordance with the invention is made up of individual guide sections disposed in known manner onto the mineral e.g., coal, face side of a scraper chain conveyor. In the conventional manner the conveyor has a series of individual channel-sections or pans disposed end-to-end and interconnected so as to be pivotable in respect of one another within certain limits and to resist tractional stress. In FIGS. 1 and 2 the side wall 2 of one of the pans adjacent to the face is represented. The plough guide sections each have a length which is in general about equal to that of the individual pans of the scraper chain conveyor. The plough itself is not shown in the drawing, as it is already known in a number of constructional versions.

Each section of the plough guide 1 consists of an angle plate 3, a robust guide beam 4, spacers 5, fitment plates 6 and a pivotable covering hood 7. The angle plate 3, extending approximately over the length of the conveyor pan, has an L-shaped profile with an upwardly extending side 8 and a lower wall portion 9 which extends towards the face. The portion 9 is slightly inclined in relation to the floor 10 and forms a lower slide support path for the plough body and also, in conjunction with the guide beam 4, a lower guide region for the plough. The strong guide beam 4, extends upwards as far as the tops of the spacers 5 and terminates at a distance spaced from the portion 9 of the angle plate 3, thus forming a gap for the engagement of the plough with a chain 13 which runs in upper and lower guide channels 11, 12 separated by the spacers 5. The beam 4 also combines with the covering hood 7 to form a cover for the chain channels 11 and 12.

The covering hood 7 is pivotably mounted at each of its two ends in an open pivot joint of which the position of the axis is indicated at the point marked 14 in FIG. 1, so that it can be moved on its joints from the closed position, shown in full lines, into the open position indicated at 7', access thus being afforded to the upper chain channel 11 and via this latter to the lower chain channel 12 likewise.

At the upper end of the side 8 of the angle plate 3 a strong upper guide bar 15 forming a prolongation thereof is welded on above the fitment plates 6 to form the upper guide region for the plough. The covering hood 7 has a welded-on contact bar 16 by which it is secured by nuts and bolts 17 to the guide bar 15 when in the closed position.

FIG. 3 depicts an assembly representing one of the guide sections without the hood 7 and the angle plate 3. The spacers 5 are situated between the guide beam 4 and the fitment plates 6, and are firmly welded to these two parts at the ends. The plates 6, which are intended to rest flat against the upwardly extending side 8 of the associated angle plate 3 also are welded thereto. The sub-assembly of the guide section composed of parts 3, 4, 5 and 6, then forms a single part all-welded structure built onto the side of the relevant pan of the scraper chain conveyor with the angle plate 3 resting with its vertical side 8 against the side wall 2 of the pan.

Figure 4:
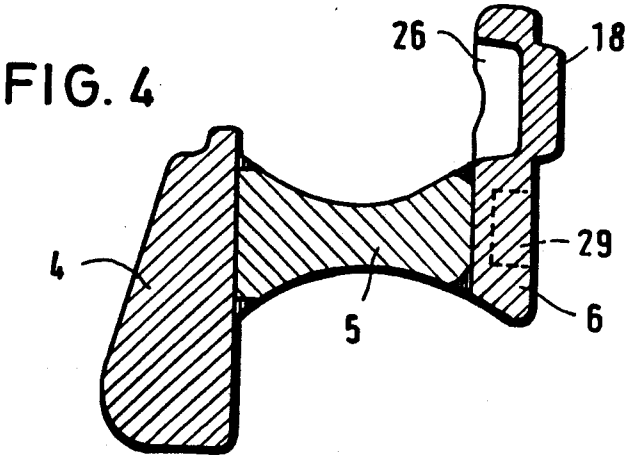
FIG. 4 is a cross-section through part of the assembly shown in FIG. 3.

The guide beam 4 consists of a solid section iron, preferably a rolled section with high resistance to wear. The rounded profile, of solid material throughout, increases in thickness towards the lower end of the guide beam 4. The fitment plates 6 are advantageously produced in the form of drop forgings. As may be seen from FIG. 3, each section of the plough guide is provided, on its guide beam 4 extending over its entire length, with two spaced-apart sliding spacers 5 and with two likewise spaced-apart fitment plates 6 each of which has a length approximately equal to that of one of the sliding spacers 5. The spacers 5 with the fitment plates 6 are situated in the two end zones of the guide beam 4. The fitment plates 6 welded to the spacers 5 extend upwards beyond the spacers 5, as shown in FIGS. 1, 2 and 4 to form the internal lateral boundary of the upper channel 11. The plates 6 are provided with centering pins 18 forged onto them and projecting towards the side 8 of the angle plate 3. Each fitment plate 6 has two such strong centering pins 18 (FIG. 3) situated at a set distance from one another. The centering pins 18 of the plates 6 engage centering apertures 19 on the side 8 of the angle plate 3, so that the assembly consisting of the components 4, 5 and 6 is reliably centered on the plate 3, at the same time providing form-closed connections of the dowel-tenon type between the plates 6 and the side 8 of the angle plate 3. The centering pins 18 are on a level with the upper chain channel 11. The fitment plates 6 overlap the vertical side 8 of the angle plate 3 to rest by an ample surface against the side 8 and are rigidly connected thereto with long weld seams.

In the version shown in FIG. 1 the plough guide section is also welded to the conveyor pan on the face side. The guide beam 4, sliding spacers 5, the fitment plates 6 and the angle plate 3 already form a single part welded structure. The upwardly extending side 8 of the angle plate 3 is welded to the top and bottom of the side wall 2 in such a way as to rest flat against it.

In the embodiment illustrated in FIG. 2, on the other hand, the guide section is screwed to the side wall 2 of the conveyor pan. This is achieved by means of two rows of threaded elements e.g. screws or bolts situated one above the other. The lower row of element 20, which pass through holes in the guide beam 4, the sliding spacers 5, the plates 6 and the side 8 of the angle plate 3 and rest by their heads 21 against barrier plate holders welded in the known manner into the shaped groove or recess in the side wall 2, approximately on a level with the conveyor floor 22 of the pan. Nuts 23 mounted on the elements 20 rest in compartments of the guide beam 4.

The second row of elements 24 is on a level with the upper chain channel 11. The elements 24 likewise rest by their heads against barrier plate holders welded into the profiled recess in the side wall 2. The plates 6 are provided in the positions of the centering pins 18 with recesses 26 which accommodate nuts 27 mounted on the elements 24.

Figure 5:
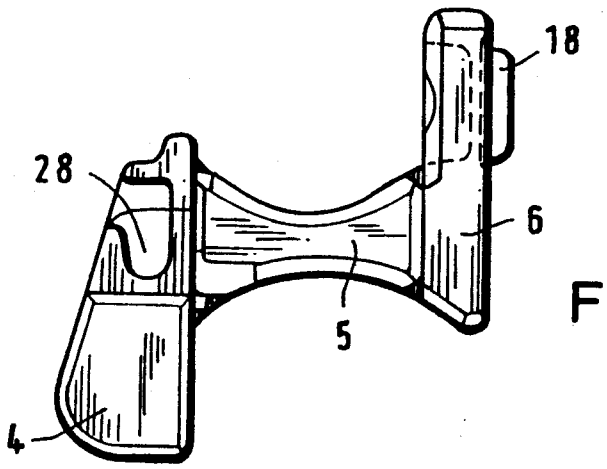
FIG. 5 is an end view of the assembly taken in the direction shown by the arrow V of FIG. 3.

As shown by FIG. 5, both ends of the guide beam 4 are provided with hinge bearings 28 open towards the top and consisting of bearing pieces welded into recesses of the guide beam 4. Hinge pins secured at the ends of the covering hood 7 engage the hinge bearings 28, so that the hood 7, as shown at 7' in FIGS. 1 and 2, can be moved over on its pivot joint, towards the face after the nuts and bolts 17 have been released.

The robust fitment plates 6 provided at the two end zones of the guide section can at the same time be utilized for connecting up adjacent pairs of guide sections preferably with the aid of toggle couplers, which are introduced into recesses of the plates 6 and secured in their coupled position. FIG. 4 shows a compartment 29 for such a connector. The compartments 29 at the abutting ends of the plough sections are open towards the chain channel 11, so that a toggle coupler can be introduced. The compartments 29 are preferably situated on a level with the spacers 5 on the fitment plates 6, which in this position project beyond the spacers 5 and as far as the associated end of the plough section.

We claim:

1. In a guide for mineral winning plough comprising angle plates with upwardly extending walls which serve for connection to the working face side of the runs of channelling of a scraper chain conveyor and lower walls extending outwardly from the upwardly extending walls towards a working face to form a support for the plough, spacers which are spaced apart between an upper and a lower chain channel for a drive chain for the plough and which are connected with the upwardly extending walls of the angle plates, a covering made up of pivotable covering hoods which shuts off the chain channels from the working face and a guide beam forming a lower plough guide region spaced apart from the lower walls of the angle plates; the improvement comprising the spacers are connected to the upwardly extending walls of the angle plates with the aid of fitments which are rigidly connected to the spacers and which extend upwards beyond the spacers to form an internal lateral boundary of the upper chain channel; wherein the fitments overlap with the upwardly extending walls of the angle plates and are provided with centering pins engaging apertures in said upwardly extending walls of the angle plates.

2. A plough guide according to claim 1, wherein the fitments are welded to the spacers.

3. A plough guide according to claim 1 wherein the fitments consist of forgings.

4. A plough guide according to claim 1, wherein the centering pins of the fitments have recesses and holes for receiving screw-threaded elements which are used to secure the plough guide to side walls of the runs of channelling.

5. A plough guide according to claim 1, wherein the upstanding sides of the angle plates are welded to side walls of the runs of channelling.

6. A plough guide according to claim 1, wherein guide bars extend above the top of the upstanding sides of the angle plates and are welded thereto and wherein the covering hoods rest with contact bars against the associated guide bars and are detachably connected thereto by screw connections.

7. A plough guide according to claim 1, wherein the covering hoods are pivotably mounted at their ends with pivot joints situated on a level with the spacers.

8. In a guide for a mineral winning plough comprising angle plates with upwardly extending walls which serve for connection to the working face side of the runs of channelling of a scraper chain conveyor and lower walls extending outwardly from the upwardly extending walls towards a working face to form a support for the plough, spacers which are spaced apart between an upper and a lower chain channel for a drive chain for the plough and which are connected with the upwardly extending walls of the angle plates, a covering made up of pivotable covering hoods which shuts off the chain channels from the working face and a guide beam forming a lower plough guide region spaced apart from the lower walls of the angle plates; the improvement comprising the spacers are connected to the upwardly extending walls of the angle plates with the aid of fitments which are rigidly connected to the spacers and which extend upwards beyond the spacers to form an internal lateral boundary of the upper chain channel and the fitments are welded to the upwardly extending walls of the angle plates.

9. In a guide for a mineral winning plough comprising angle plates with upwardly extending walls which serve for connection to the working face side of the runs of channelling of a scraper chain conveyor and lower walls extending outwardly from the upwardly extending walls towards a working face to form a support for the plough, spacers which are spaced apart between an upper and a lower chain channel for a drive chain for the plough and which are connected with the upwardly extending walls of the angle plates, a covering made up of pivotable covering hoods which shuts off the chain channels from the working face and a guide beam forming a lower plough guide region spaced apart from the lower walls of the angle plates; the improvement comprising the spacers are connected to the upwardly extending walls of the angle plates with the aid of fitments which are rigidly connected to the spacers and which extend upwards beyond the spacers to form an internal lateral boundary of the upper chain channel, the guide is composed of guide sections arranged end-to-end and each guide section includes an assembly composed of a section of the guide beam, a number of spacers and fitments and one of the angle plates which are combined to form a single welded structure.

10. In a guide for a mineral winning plough comprising angle plates with upwardly extending walls which serve for connection to the working face of the runs of channelling of a scraper chain conveyor and lower walls extending outwardly from the upwardly extending walls towards a working face to form a support for the plough, spacers which are spaced apart between an upper and a lower chain channel for a drive chain for the plough and which are connected with the upwardly extending walls of the angle plates, a covering made up of pivotable covering hoods which shuts off the chain channels from the working face and a guide beam forming a lower plough guide region spaced apart from the lower walls of the angle plates; the improvement comprising the spacers are connected to the upwardly extending walls of the angle plates with the aid of fitments which are rigidly connected to the spacers and which extend upwards beyond the spacers to form an internal lateral boundary of the upper chain channel, the guide beam is made up of sections and the guide beam sections consist of rolled section iron formed entirely of solid material which increases in thickness from the top towards the bottom.

11. In a guide for a mineral winning plough comprising angle plates with upwardly extending walls which serve for connection to the working face side of the runs of channelling of a scraper chain conveyor and lower walls extending outwardly from the upwardly extending walls towards a working face to form a support for the plough, spacers which are spaced apart between an upper and a lower chain channel for a drive chain for the plough and which are connected with the upwardly extending walls of the angle plates, a covering made up of pivotable covering hoods which shuts off the chain channels from the working face and a guide beam forming a lower plough guide region spaced apart from the lower walls of the angle plates; the improvement comprising the spacers are connected to the upwardly extending walls of the angle plates with the aid of fitments each with a length at least approximately equal to that of one of the spacers the fitments being rigidly connected to the spacers to extend upwards beyond the spacers to form an internal lateral boundary of the upper chain channel, the guide is subdivided into sections each associated with one of the runs of channelling with the spacers being situated in the respective end zones of the plough guide sections and sections of the guide beam and fitments are provided with compartments on a level with the spacers, the compartments serving to receive coupling elements used to interconnect the adjacent plough guide sections.

* * * * *